US009134012B2

(12) United States Patent
Wu

(10) Patent No.: US 9,134,012 B2
(45) Date of Patent: Sep. 15, 2015

(54) LIGHTING DEVICE WITH OMNIDIRECTIONAL LIGHT EMISSION AND EFFICIENT HEAT DISSIPATION

(71) Applicant: Hong Kong Applied Science and Technology Research Institute Company Limited, Hong Kong (HK)

(72) Inventor: Kai Chiu Wu, Hong Kong (HK)

(73) Assignee: Hong Kong Applied Science and Technology Research Institute Company Limited, Hong Kong Science Park, Shatin, New Territories (HK)

( * ) Notice: Subject to any disclaimer, the term of this patent is extended or adjusted under 35 U.S.C. 154(b) by 102 days.

(21) Appl. No.: 13/972,906

(22) Filed: Aug. 22, 2013

(65) Prior Publication Data

US 2014/0347863 A1 Nov. 27, 2014

Related U.S. Application Data

(60) Provisional application No. 61/826,016, filed on May 21, 2013.

(51) Int. Cl.
*F21V 1/00* (2006.01)
*F21V 14/02* (2006.01)
(Continued)

(52) U.S. Cl.
CPC ..... *F21V 14/02* (2013.01); *F21K 9/1355* (2013.01); *F21K 9/58* (2013.01); *F21V 29/70* (2015.01)

(58) Field of Classification Search
CPC ..... F21V 29/004; F21V 29/20–29/2293; F21V 29/267; F21K 9/10–9/1375
USPC ..... 362/238–239
See application file for complete search history.

(56) References Cited

U.S. PATENT DOCUMENTS 8,314,537 B2 11/2012 Gielen et al.
2006/0203465 A1* 9/2006 Chang et al. ..... 362/29
(Continued)

FOREIGN PATENT DOCUMENTS

CN 101329054 A 12/2008
CN 101539284 A 9/2009
(Continued)

OTHER PUBLICATIONS

Office Action issued from the State Intellectual Property Office of the People's Republic of China on Jan. 28, 2015.

*Primary Examiner* — Sean Gramling
(74) *Attorney, Agent, or Firm* — Ella Cheong Hong Kong; Sam T. Yip

(57) ABSTRACT

This invention discloses a lighting device for omnidirectional light emission with efficient heat dissipation. In one embodiment, a lighting device comprises lighting modules circumferentially arranged such that generation of the omnidirectional light is allowable, and a supporting unit attached to each lighting module's heat-dissipating side for providing mechanical support. A space formed by minimally enclosing all the lighting modules includes a first polar opening, a second polar opening opposite thereto, and a ventilation channel between the two polar openings for enabling air flowing through the ventilation channel to carry away at least part of heat obtained from the heat-dissipating sides of the lighting modules to outside said space. A line-of-sight path between the two polar openings is identifiable, allowing a direct flow of air that advances through the ventilation channel between the two polar openings to be realizable, thereby promoting the carrying away of heat to outside said space.

15 Claims, 6 Drawing Sheets

(51) Int. Cl.
*F21K 99/00* (2010.01)
*F21V 29/70* (2015.01)

(56) References Cited

U.S. PATENT DOCUMENTS

2007/0230185 A1* 10/2007 Shuy ..... 362/294
2009/0303717 A1* 12/2009 Long et al. ..... 362/249.02
2011/0032708 A1 2/2011 Johnston et al.
2011/0164428 A1* 7/2011 Brutsche et al. ..... 362/427
2011/0242817 A1 10/2011 Chowdhury et al.
2013/0010463 A1 1/2013 Li et al.
2013/0070458 A1 3/2013 Shi
2013/0088849 A1 4/2013 Lee et al.

FOREIGN PATENT DOCUMENTS

CN 102128370 A 7/2011
CN 201954312 U 8/2011
CN 102918321 A 2/2013

* cited by examiner

LIGHTING DEVICE WITH OMNIDIRECTIONAL LIGHT EMISSION AND EFFICIENT HEAT DISSIPATION

CROSS-REFERENCE TO RELATED APPLICATIONS

This application claims the benefit of U.S. Provisional Application No. 61/826,016, filed May 21, 2013, the disclosure of which is incorporated by reference herein in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to a lighting device configured to provide omnidirectional light emission. In particular, the present invention relates to such lighting device further configured to enable efficient dissipation of heat generated by light-emitting elements in such lighting device.

BACKGROUND

In many practical situations, it is desirable to have a light source that can produce omnidirectional light emission. As an example, this light source is a ceiling lamp for illuminating the floor under this lamp. For practical consideration, it is used herein that omnidirectional light emission refers to light emission where the cone of the emitted light extends over at least half of the sphere.

Incandescent lamps have been commonly used for omnidirectional light emission. There is a trend to replace incandescent lamps with light emitting diode (LED) lamps. To provide sufficient illumination, the LED lamps are usually of high power. Efficient dissipation of heat generated by LEDs in these lamps is of paramount importance.

In US20130070458, a LED bulb supporting omnidirectional light emission with a heat-dissipating arrangement is disclosed. The LED bulb has a heat-dissipating device comprising a base, and a plurality of heat dissipating bodies installed on the base. Each of the heat dissipating bodies has a V-shaped cross section, and is fixed with a LED light source module. The heat dissipating bodies are circumferentially arranged to produce omnidirectional light. A certain space is left between adjacent two heat dissipating bodies to form an air ventilation channel for heat dissipation. However, a direct flow of air is realizable only in the horizontal direction but not in the vertical direction when the LED bulb is held upright in the vertical direction, leading to reduced heat dissipation capability.

There is a need in the art to have a lighting device that provides omnidirectional light emission and achieve improved heat dissipation capability over the one disclosed in US20130070458.

SUMMARY OF THE INVENTION

The present invention provides a lighting device for producing omnidirectional light and having features that enable efficient heat dissipation to be realizable.

The disclosed lighting device comprises a plurality of lighting modules. Each of the lighting modules comprises a heat sink. The heat sink has a light-producing side and a heat-dissipating side opposite thereto. The light-producing side comprises one or more light-emitting elements mounted to the heat sink for producing light. The heat-dissipating side is configured to dissipate heat produced by the one or more light-emitting elements. In addition, the lighting modules are circumferentially arranged with the light-producing side of the heat sink of any of the lighting modules facing outward such that generation of the omnidirectional light is allowable. The lighting unit further comprises a supporting unit attached to the heat-dissipating side of the heat sink of each of the lighting modules for providing mechanical support to the lighting modules.

In addition, the supporting unit and the lighting modules are arranged and configured in such a way that a space formed by minimally enclosing an entirety of the lighting modules includes a first polar opening, a second polar opening opposite thereto, and a ventilation channel between the first and the second polar openings. The ventilation channel is used for enabling air flowing therethrough to carry away at least a portion of heat obtained from the heat-dissipating sides of the heat sinks of the lighting modules to outside said space. In particular, a line-of-sight path between the first polar opening and the second polar opening is identifiable. The presence of the line-of-sight path allows a direct flow of air that advances through the ventilation channel from the first polar opening to the second polar opening, or vice versa, to be realizable, thereby promoting the carrying away of the at least a portion of heat to outside said space.

Preferably, said space further includes a plurality of lateral openings. Each of the lateral openings is located between adjacent two of the lighting modules and is connected to the ventilation channel. As a result, air is allowed to flow into and out of the ventilation channel via the lateral openings as well as via the first and the second polar openings, thereby further promoting the carrying away of the at least a portion of heat to outside said space. It is preferable that at least one of the lateral openings is connected to both the first and the second polar openings. More desirably, each of the lateral openings is connected to both the first and the second polar openings. It causes the first polar opening, the second polar opening and an entirety of the lateral openings to form a single opening encircling said space, thereby allowing air to flow into and out of the ventilation channel in multiple directions without being substantially blocked.

Optionally, at least one of the lighting modules has the heat-dissipating side that comprises a nanostructure layer coated thereon. The nanostructure layer is configured to induce micro-turbulences in air that flows on the nanostructure layer so as to promote transfer of heat energy from the aforesaid heat-dissipating side to surrounding air.

Another option is that at least one of the lighting modules has the heat-dissipating side that comprises fins protruding therefrom. The fins are configured to promote transfer of heat energy therein to air that flows along the fins. The fins may be collectively oriented in a pointing direction approximately parallel to, or approximately perpendicular to, the supporting unit's orientation. Furthermore, a substantial portion of the fins may be coated with a nanostructure layer so as to promote transfer of the heat energy from the fins to surrounding air.

The light-producing side of the heat sink of any of the lighting modules has an accommodating surface for accommodating the one or more light-emitting elements. The accommodating surface comprises plural sub-surfaces arranged in mutually different orientations so as to provide an illumination angle of light collectively produced by the one or more light-emitting elements substantially wider than an illumination angle obtained if the accommodating surface is flat. In one option, the sub-surfaces are arranged such that the accommodating surface is convex in shape. In another option, the sub-surfaces are arranged to provide a concave surface to the accommodating surface.

The heat-dissipating side of the heat sink of any of the lighting modules may be attached to the supporting unit directly or via a joining member. The joining member is configured to discourage heat transfer from the aforesaid heat-dissipating side to the supporting unit. Optionally, the joining member may be remotely controllable and movable such that light collectively produced by the one or more light-emitting elements of any of the lighting modules has a direction that is reconfigurable.

The present invention also provides an assembly configured to be used in a lighting device for producing omnidirectional light. The assembly includes features that enable efficient heat dissipation to be realizable.

The disclosed assembly comprises a plurality of lighting modules. Each of the lighting modules comprises a heat sink. The heat sink has a light-producing side and a heat-dissipating side opposite thereto. The light-producing side comprises an accommodating surface configured to accommodate one or more light-emitting elements for producing light. The heat-dissipating side is configured to dissipate heat produced by the one or more light-emitting elements. The lighting modules are circumferentially arranged with the light-producing side of the heat sink of any of the light-producing modules facing outward such that generation of the omnidirectional light is allowable. The assembly further comprises a supporting unit attached to the heat-dissipating side of the heat sink of each of the lighting modules for providing mechanical support to the lighting modules.

The supporting unit and the lighting modules may be individually formed and then fixed together. Alternatively, the supporting unit and an entirety of the lighting modules without any light-emitting element may be preformed as one integrated unit.

Except that the one or more light-emitting elements may not be present in each of the lighting modules of the assembly, other features of the assembly are substantially similar to corresponding features of the lighting device disclosed above.

DETAILED DESCRIPTION OF THE INVENTION

An aspect of the present invention is to provide a lighting device for producing omnidirectional light and including features that enable efficient heat dissipation to be realizable.

Figure 1:
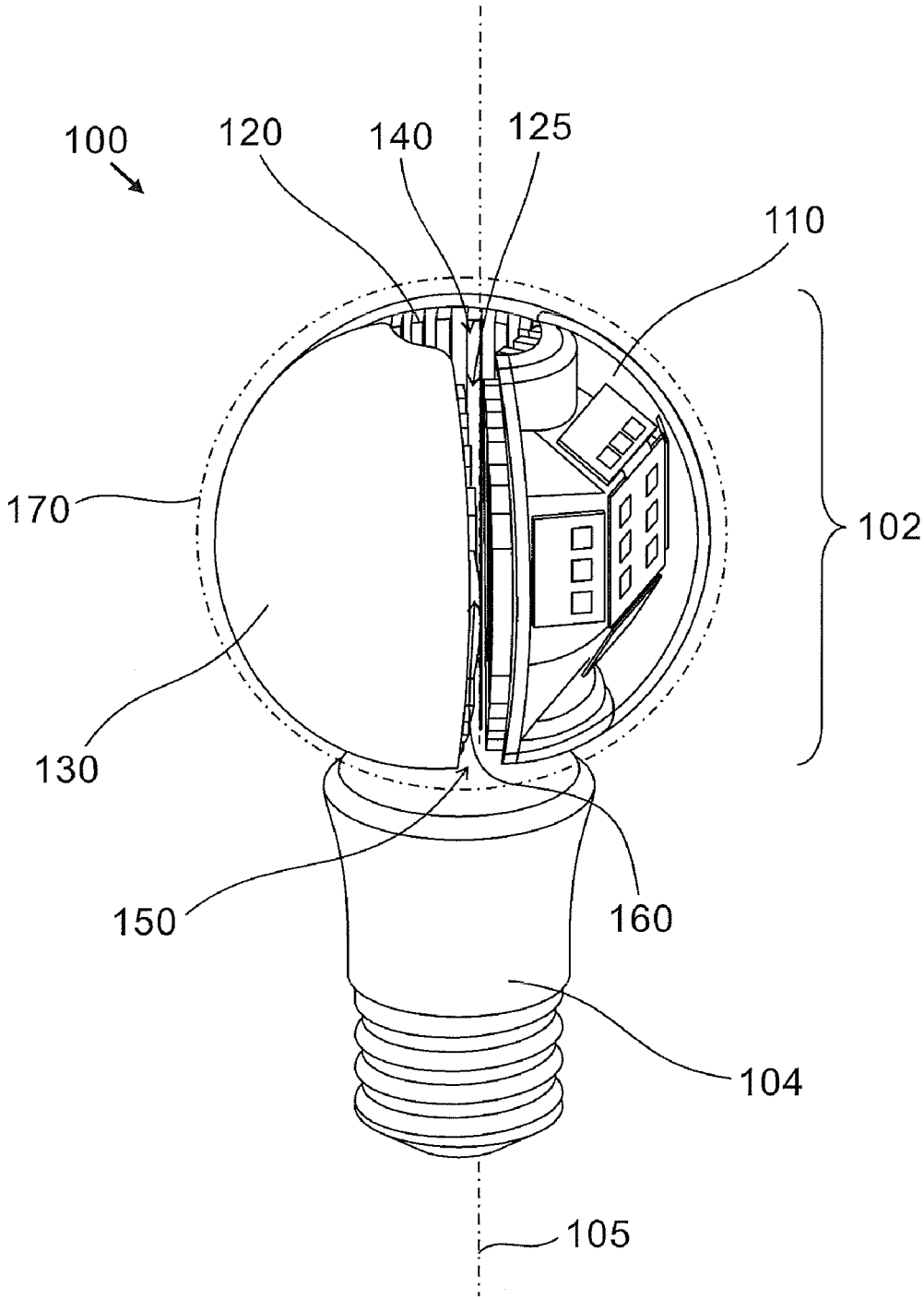
FIG. 1 depicts a lighting device in accordance with an exemplary embodiment of the present invention.
Figure 2:
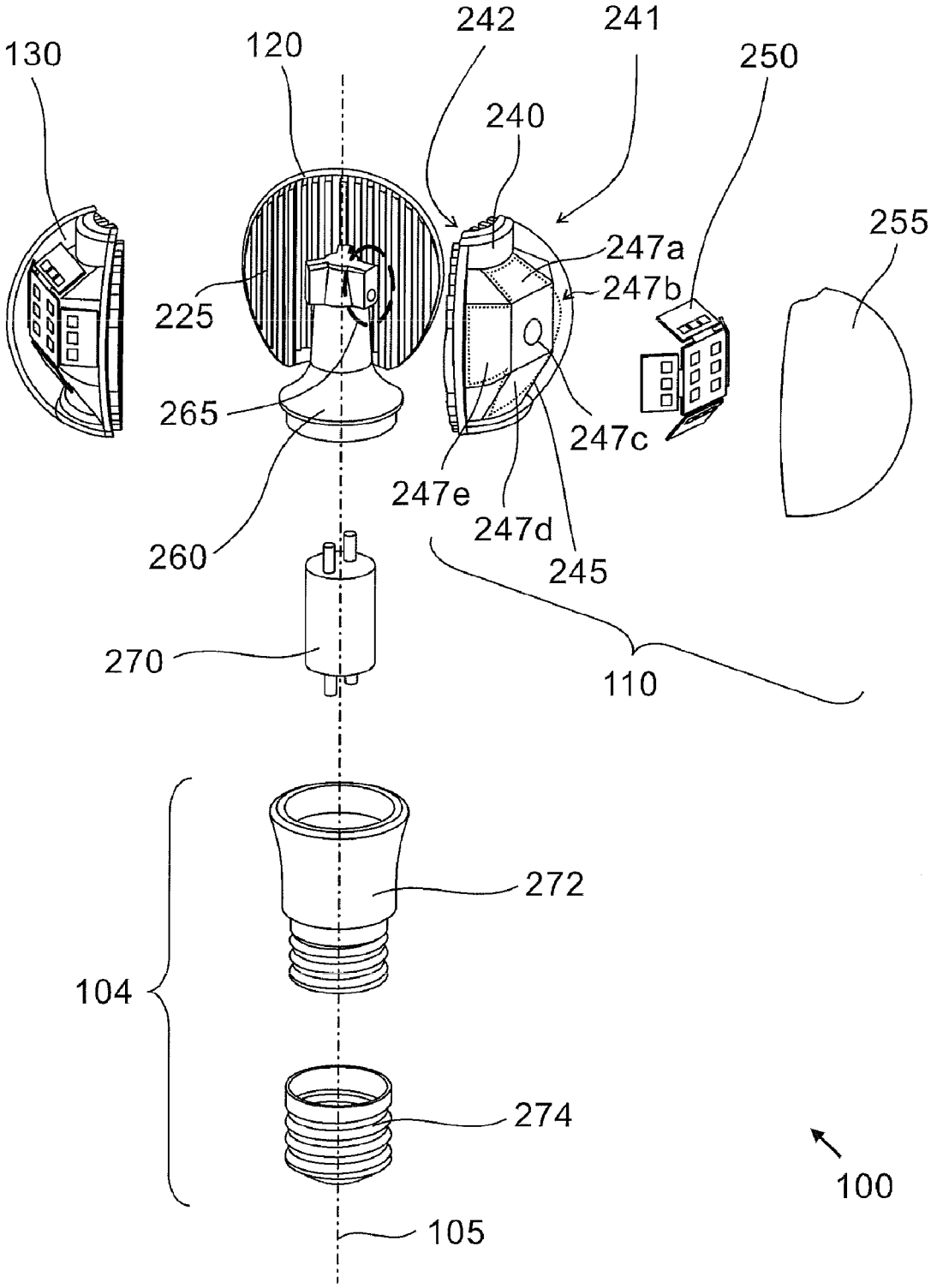
FIG. 2 provides an exploded view of this lighting device.

FIG. 1 shows a lighting device according to an exemplary embodiment of the present invention, and FIG. 2 depicts an exploded view of this lighting device. For the purpose of describing the present invention, the lighting device shown in FIG. 1 is depicted in a form of an industrially-standardized A19 light bulb. However, the present invention is not limited only to this form. As shown in FIG. 1, a lighting device 100 has a light-producing part 102 and a driving base 104. The light-producing part 102 comprises a plurality of lighting modules 110, 120, 130. Although three lighting modules 110, 120, 130 are shown in FIG. 1 for the purpose of illustration, the present invention is not limited to only three lighting modules. The present invention only requires that the number of lighting modules is at least two.

Refer to FIG. 2. Take the lighting module 110 as an illustrating example. The lighting module 110 comprises a heat sink 240. Preferably, the heat sink 240 is made of thermally conductive material such as aluminum, allowing efficient transfer of heat throughout the heat sink 240 to thereby enable efficient heat transfer to the ambient environment. The heat sink 240 has a light-producing side 241 and a heat-dissipating side 242 opposite to the light-producing side 241. The light-producing side 241 comprises an accommodating surface 245 configured to accommodate one or more light-emitting elements, preferably one or more LEDs, for producing light. Preferably, the accommodating surface 245 comprises plural sub-surfaces 247*a*-247*e* arranged in mutually different orientations so as to configure the accommodating surface 245 to provide an illumination angle of light collectively produced by the one or more light-emitting elements substantially wider than an illumination angle obtained if the accommodating surface 245 is flat. The sub-surfaces 247*a*-247*e* may be arranged such that the accommodating surface 245 is convex (as shown in FIG. 2) or concave (not shown in FIG. 2) in shape. As the one or more light-emitting elements are preferably realized as one or more LEDs, both the convex and the concave arrangements of the accommodating surface 245 have an advantage in widening the cone of light emitted from the lighting module 110 such that generation of omnidirectional light by the lighting device 100 is made easier. In practical implementations, the one or more light-emitting elements may be packaged and integrated as a LED module 250 such that the LED module 250 can be conveniently mounted on the accommodating surface 245. Typically, a cover 255 is put on the light-producing side 241 of the heat sink 240. In one example, the cover 255 may be a diffuser for diffusing the light produced by the one or more light-emitting elements. In another example, the cover 255 may include remote phosphor for converting the light produced by the one or more light-emitting elements into light having a desired color.

In order to generate the omnidirectional light, the lighting modules 110, 120, 130 are circumferentially arranged with the light-producing sides of the heat sinks of these lighting modules 110, 120, 130 facing outward. Furthermore, the lighting device 100 includes a supporting unit 260 attached to the heat-dissipating side of the heat sink of each of the lighting modules 110, 120, 130 for providing mechanical support to the light-producing modules 110, 120, 130. The supporting unit 260 has a central axis 105, which is an imaginary straight line passing through the supporting unit 260 and forming a reference to indicate the supporting unit 260's orientation. Refer to FIG. 1. The supporting unit 260 and the lighting modules 110, 120, 130 are arranged and configured such that a space 170 formed by minimally enclosing an entirety of the lighting modules 110, 120, 130 includes a first polar opening 140, a second polar opening 150 opposite to the first polar opening 140, and a ventilation channel 125 between the first polar opening 140 and the second polar opening 150. The ventilation channel 125 is used for enabling air flowing therethrough to carry away at least a portion of heat obtained from the heat-dissipating sides of the heat sinks of the lighting modules 110, 120, 130 to outside the space 170. Herein in the specification and in the appended claims, a space formed by minimally enclosing an entirety of lighting modules is defined as a three-dimensional space that: bounds all the lighting modules; and has a surface area that is minimum among all possible spaces that bound all these lighting modules. A property of the aforesaid three-dimensional space is that its surface is in contact with part of the surfaces of the lighting modules. As shown in FIG. 1, the space 170 contacts the cover 255 (shown in FIG. 2) of the lighting module 110. As used herein, an opening on a space formed by minimally enclosing an entirety of lighting modules is a physical opening that allows air to flow into or out of this space. In addition, a pole as used herein is a point on the space 170's surface intersecting with the central axis 105. A polar opening as used herein is an opening located on a pole, or located in the neighborhood of the pole but not including the pole. Since the supporting unit 260 crosses the space 170's outer surface, it follows that the second polar opening 150 is shaped as an annular ring. It is preferable, as will be evidenced soon, that the space 170 includes a plurality of lateral openings (e.g., a lateral opening 160), each of which is connected to the ventilation channel 125. The lateral opening 160 is a side slit between adjacent two of the lighting modules 110, 130. The lateral opening 160 may be formed by positioning the lighting modules 110, 130 such that they are physically disjoint.

Figure 3:
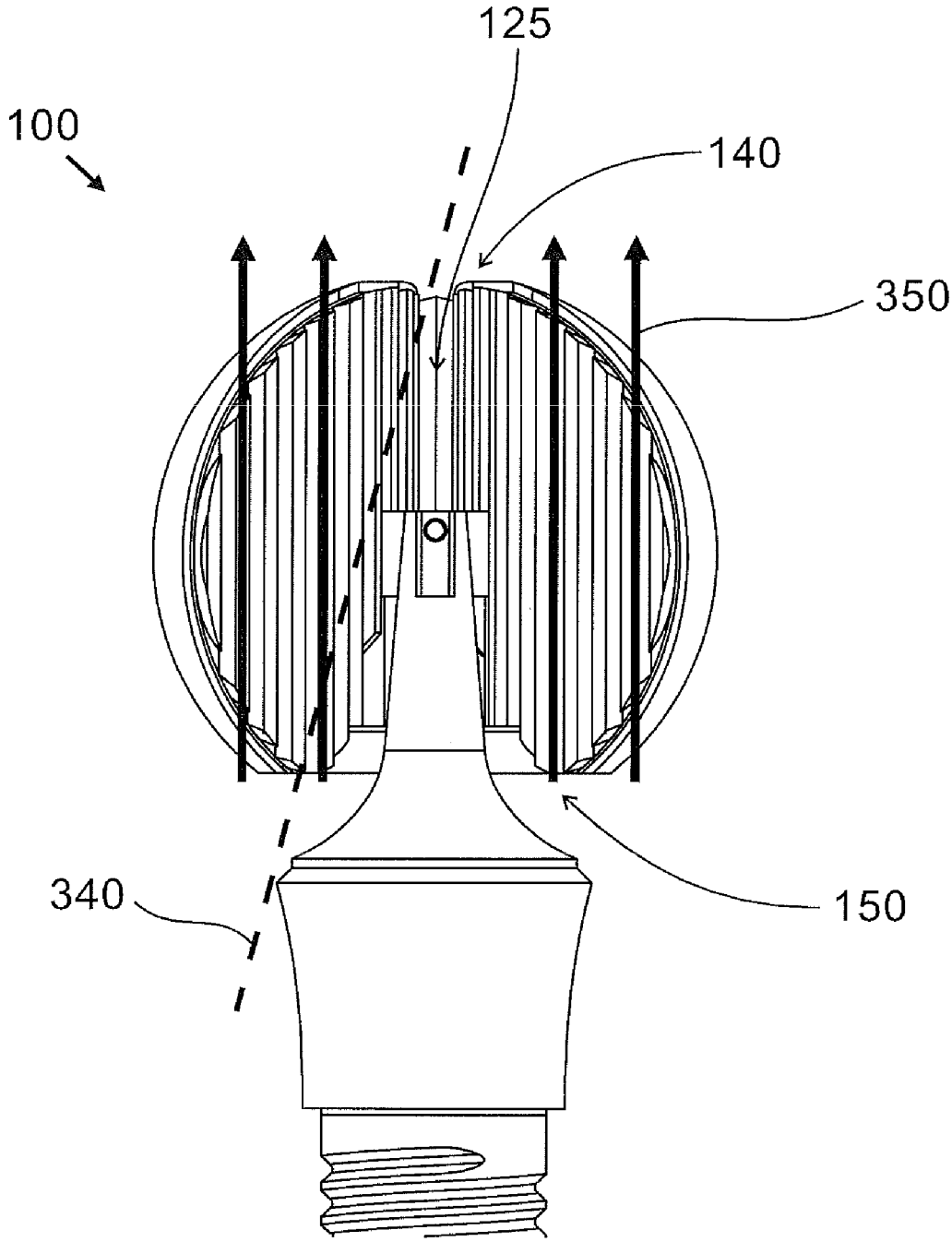
FIG. 3 depicts a cross-sectional view of the lighting device, illustrating the presence of a line-of-sight path between two polar openings of the lighting device.

FIG. 3 depicts a cross-sectional view of the lighting device 100. In the lighting device 100, a line-of-sight path 340 between the first polar opening 140 and the second polar opening 150 can be identified. The presence of the line-of-sight path 340 enables a direct flow of air that advances through the ventilation channel 125 from the first polar opening 140 to the second polar opening 150, or vice versa, to be realizable. It gives rise to an advantage of promoting the carrying away of the at least a portion of heat to outside the space 170. In the presence of lateral openings (including the lateral opening 160), the flow of air is along a direction 350. Since heated air naturally rises from a lower position to a higher position, the direct flow of air leads to an unobstructed air flow from a polar opening at the bottom to another polar opening at the top. Since the lighting device 100 is usually held vertically in an upright direction or more often in an inverted direction (e.g., as a ceiling lamp) during operation, the unobstructed air flow from the bottom to the top allows cool air to more easily enter the ventilation channel 125, increasing the heat dissipation rate at the heat-dissipating side of the heat sink of any of the lighting modules 110, 120, 130.

Figure 4:
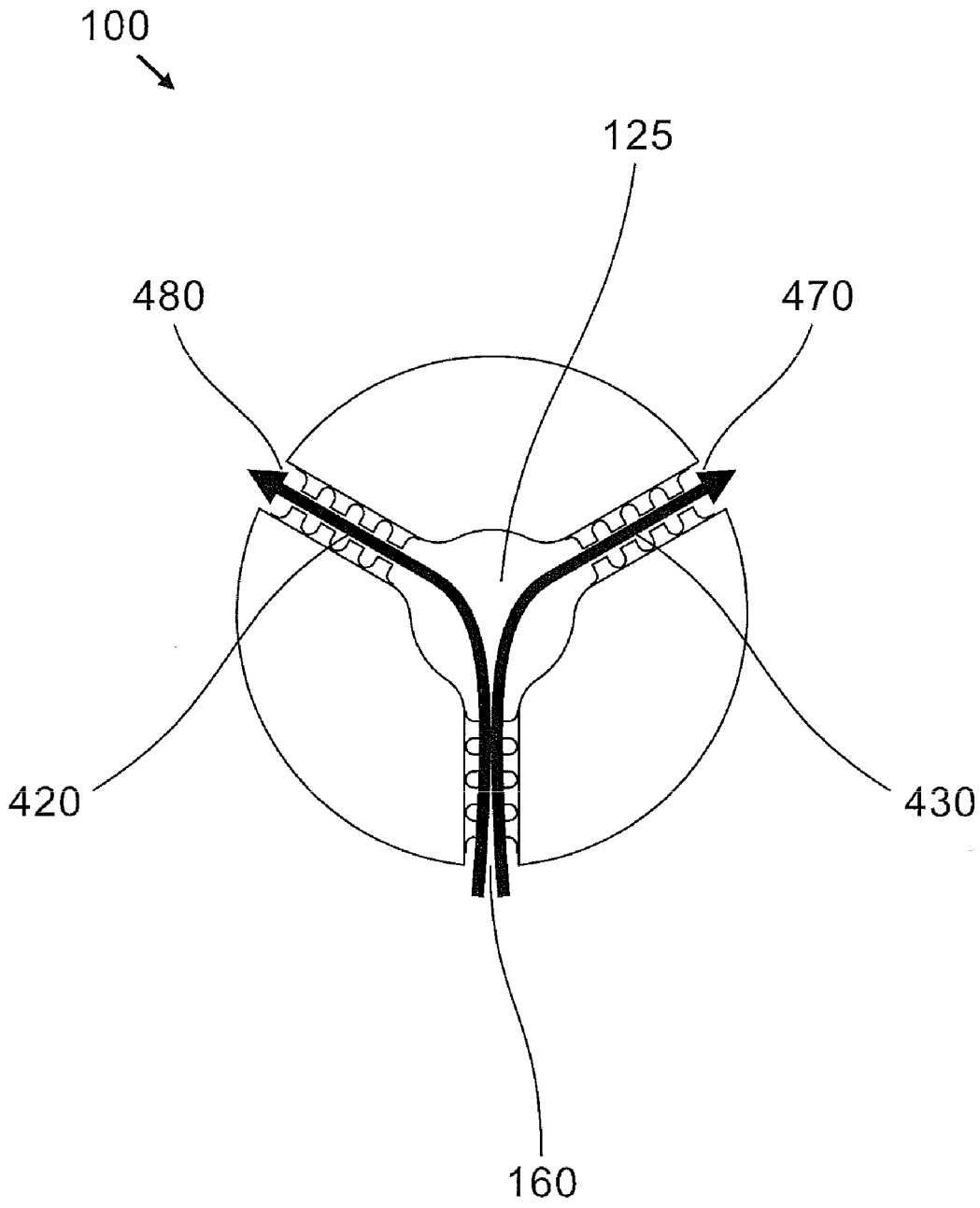
FIG. 4 depicts a top view of the lighting device, illustrating that air ventilation can be made through lateral openings of the lighting device.

FIG. 4 depicts a top view of the lighting device 100. The presence of the plurality of lateral openings 160, 470, 480 allows air to flow into and out of the ventilation channel 125 via the lateral openings 160, 470, 480 as well as via the first polar opening 140 and the second polar opening 150, thereby further promoting the carrying away of the at least a portion of heat to outside the space 170.

It is possible that all of the lateral openings 160, 470, 480 may not connect to either one or both of the first polar opening 140 and the second polar opening 150. However, it is preferable that at least one of the lateral openings 160, 470, 480 is connected to both the first polar opening 140 and the second polar opening 150. More desirably, each of the lateral openings 160, 470, 480 is connected to both the polar openings 140, 150. This arrangement causes the first polar opening 140, the second polar opening 150 and an entirety of the lateral openings 160, 470, 480 to form a single opening encircling the space 170. As a result, it allows air to flow into and out of the ventilation channel 125 in multiple directions 420, 430 without being substantially blocked. In some practical applications, the lighting device 100 (e.g., a wall-mounted lamp) is held horizontally. Since heated air rises from bottom to top, allowing air to flow into and out of the ventilation channel 125 in multiple directions 420, 430 provides an advantage of enabling efficient heat dissipation for applications that require the lighting device 100 to be held horizontally.

Providing the direct air flow between the first polar opening 140 and the second polar opening 150 and allowing air to flow in and out of the ventilation channel 125 in multiple directions 420, 430 enable unobstructed movement of air so as to achieve efficient heat dissipation. Another factor for achieving efficient heat dissipation is to provide an efficient means to transfer heat energy from the heat-dissipating side of the heat sink of any of the lighting modules 110, 120, 130 to surrounding air that flows through the ventilation channel 125. In one embodiment, at least one of the lighting modules 110, 120, 130 has the heat-dissipating side that comprises a nanostructure layer coated thereon. The nanostructure layer is configured to induce micro-turbulences in air that flows on the nanostructure layer. The micro-turbulences are generated so as to promote transfer of heat energy from the aforesaid heat-dissipating side to surrounding air. In another embodiment, at least one of the lighting modules 110, 120, 130 has the heat-dissipating side that comprises fins protruding therefrom (e.g. a plurality of fins 225 of the lighting module 120 as shown in FIG. 2). In particular, the fins are configured to promote transfer of heat energy therein to air that flows along the fins. The fins may be collectively oriented in a pointing direction approximately parallel to, or approximately perpendicular to, the supporting unit 260's orientation. As mentioned above, the central axis 105 forms the reference to indicate the orientation of the supporting unit 260. Optionally, a substantial portion of the fins is coated with a nanostructure layer for inducing micro-turbulences.

The heat-dissipating side of the heat sink of each of the lighting modules 110, 120, 130 may be directly attached to the supporting unit 260. Alternatively, the heat-dissipating side of the heat sink of any of the lighting modules 110, 120, 130 may be attached to the supporting unit 260 via a joining member. For illustration, a joining member 265 is used to join the supporting unit 260 and the heat-dissipating side 242 of the heat sink 240 of the lighting module 110.

In one embodiment, the joining member 265 is configured to discourage heat transfer from the heat-dissipating side 242 to the supporting unit 260. To discourage such heat transfer, the joining member 265 may be made of plastic.

Figure 5A:
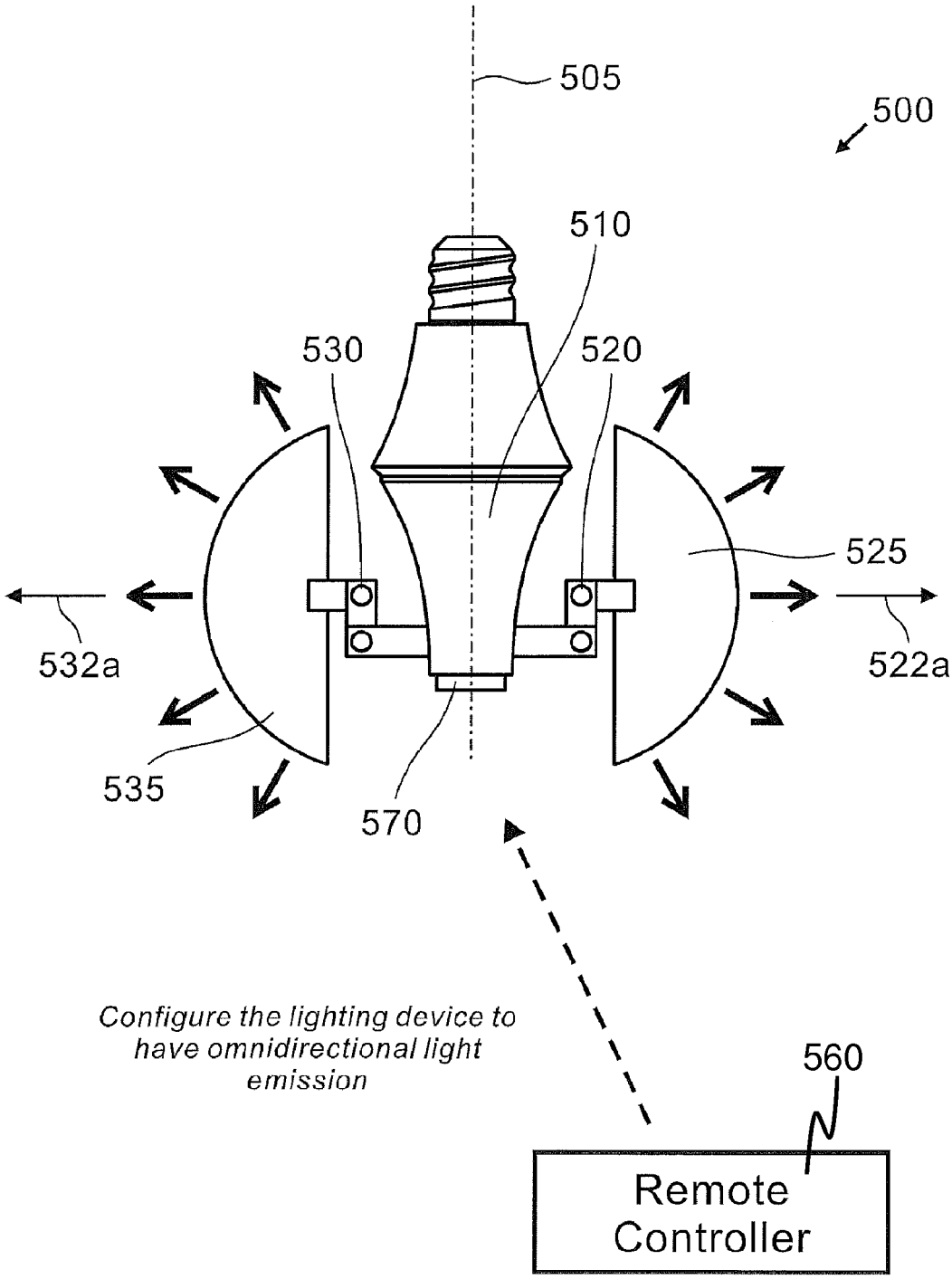
FIG. 5*a* depicts, as an example, a lighting device that is remotely controllable by a remote controller, and is configured to have an omnidirectional light emission.
Figure 5B:
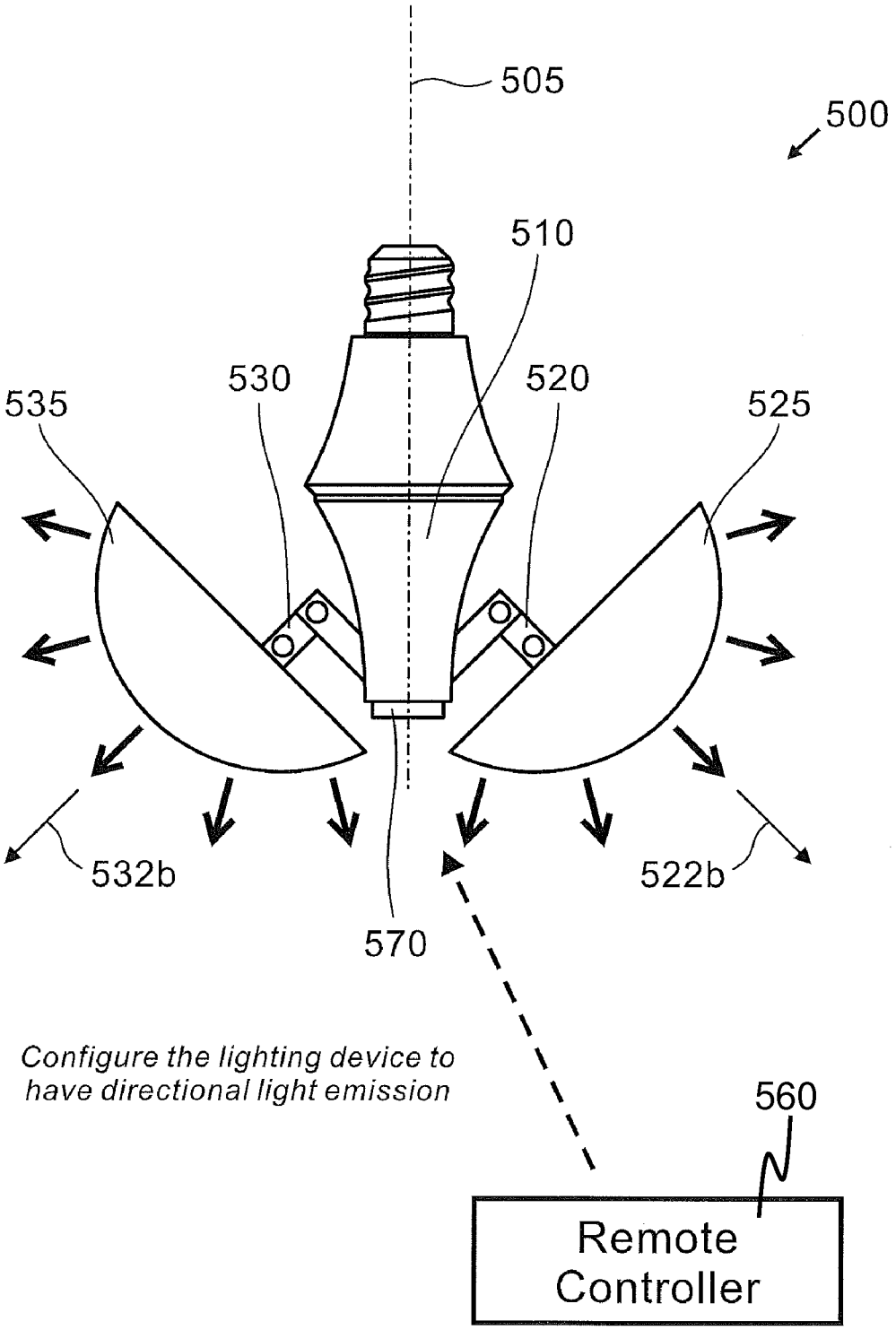
FIG. 5*b* depicts the lighting device of FIG. 5*a* where the lighting device is reconfigured to have directional light emission after receiving a command from the remote controller.

In another embodiment, the joining member 265 is remotely controllable and movable such that light collectively produced by the one or more light-emitting elements of the lighting module 110 has a direction that is reconfigurable. Being able to reconfigure an illumination direction is a practically useful feature for the lighting device 100. As an example of practical applications, such reconfigurable lighting device can be installed in a ceiling of a dinning room so that omnidirectional lighting is provided to illuminate the room evenly, but a user can remotely control this lighting device so as to direct the light produced by the lighting device toward a dinning table during dinning time. The joining member 265 can be remotely controlled through a wired connection with a controller, or by a wireless method. The wireless method may employ a radio-based wireless technique such as WiFi or may use an infrared (IR)-based technique. As an example to illustrate reconfigurability of lighting direction, FIGS. 5*a* and 5*b* depict a lighting device that is remotely controllable and is reconfigurable to provide omnidirectional light emission (FIG. 5*a*) or to provide directional light illumination (FIG. 5*b*). A lighting device 500 having a supporting unit 510 attached to lighting modules 525 and 535 via joining members 520 and 530, respectively. The supporting unit 510 has a central axis 505 forming a reference to the supporting unit 510's orientation. A remote controller 560 wirelessly sends a configuration command to the lighting device 500 and the configuration command is received at the lighting device 500 by a wireless receiver 570 attached thereto. When the command instructs the lighting device 500 to produce omnidirectional light, the joining members 520 and 530 set the lighting modules 525 and 535 to point in directions 522*a* and 532*a*, respectively, as shown in FIG. 5*a*. When the remote controller 560 sends a command to reconfigure the lighting device 500 to produce directional light, the joining members 520 and 530 are actuated to move such that the lighting modules 525 and 535 point in directions 522*b* and 532*b*, respectively, as shown in FIG. 5*b*. Movement of the joining member 520 or 530 may be in the form of, for example, rotation, or a combination of rotation and linear motion. In practical implementation, the joining member 520 or 530 may be elongated to produce such linear motion. From FIGS. 5*a* and 5*b*, it is noted that reconfiguration of the lighting direction produced by the lighting device 500 can be achieved by configuring the joining member 520 to change an angle between the central axis 505 and the pointing direction (from 522*a* to 522*b*) of the lighting module 525, and similarly configuring the joining member 530 for the lighting module 535.

The joining member 265 may include a provision for routing electrical power to the one or more light-emitting elements installed in the lighting module 110. In one embodiment, the electrical power is provided by a driver 270, which may be an electronic ballast for driving LEDs. The driver 270 is housed in the driving base 104, which may comprise a container 272 for containing the driver 270, and a terminal 274 for enabling the driver 270 to obtain electrical power from an external source.

In one method of manufacturing the lighting device 100, the lighting module 110 may be mounted with the LED module 250 before all the lighting modules 110, 120, 130 are fixed to the supporting unit 260. In another manufacturing method, the lighting modules 110, 120, 130 without any light-emitting element therein may first be fixed to the supporting unit 260 to form an assembly to be used for realizing the lighting device 100. The lighting device 100 is then formed by incorporating light-emitting elements to the assembly.

The supporting unit 260 and the lighting modules 110, 120, 130 may be individually formed and then fixed together. Alternatively, the supporting unit 260 and an entirety of the lighting modules 110, 120, 130 without any light-emitting element may be preformed as one integrated unit, for example, by molding using a single rigid frame.

The present invention may be embodied in other specific forms without departing from the spirit or essential characteristics thereof. The present embodiment is therefore to be considered in all respects as illustrative and not restrictive. The scope of the invention is indicated by the appended claims rather than by the foregoing description, and all changes that come within the meaning and range of equivalency of the claims are therefore intended to be embraced therein.

What is claimed is:

1. A lighting device for producing omnidirectional light, comprising:

a plurality of lighting modules each comprising a heat sink, the heat sink having a light-producing side and a heat-dissipating side opposite to the light-producing side, the light-producing side comprising one or more light-emitting elements mounted to the heat sink for producing light, the heat-dissipating side being configured to dissipate heat produced by the one or more light-emitting elements, the lighting modules being circumferentially arranged with the light-producing side of the heat sink of any of the lighting modules facing outward such that generation of the omnidirectional light is allowable; and a supporting unit attached to the heat-dissipating side of the heat sink of each of the lighting modules via a joining member, for providing mechanical support to the lighting modules, wherein each joining member is movable for setting a pointing direction of the lighting module attached thereto such that light collectively produced by the one or more light-emitting elements of any of the lighting modules has a lighting direction that is reconfigurable;

the supporting unit and the lighting modules being arranged and configured such that a space formed by minimally enclosing an entirety of the lighting modules includes a first polar opening, a second polar opening opposite to the first polar opening, and a ventilation channel between the first polar opening and the second polar opening for enabling air flowing through the ventilation channel to carry away at least a portion of heat obtained from the heat-dissipating sides of the heat sinks of the lighting modules to outside said space, wherein:

a line-of-sight path between the first polar opening and the second polar opening is identifiable, allowing a direct flow of air that advances through the ventilation channel from the first polar opening to the second polar opening, or vice versa, to be realizable to thereby promote the carrying away of the at least a portion of heat to outside said space;

regardless of the pointing direction of the joining member of the lighting module set by the joining member, the ventilation channel immediately adjacent the first polar opening is not occupied by the supporting unit, widening a portion of the ventilation channel such that a hollow in the ventilation channel immediately adjacent the first polar opening is created to further promote the carrying away of the at least a portion of heat; and said space further includes a plurality of lateral openings each of which is located between adjacent two of the lighting modules, and is connected to the ventilation channel as well as to both the first and the second polar openings, causing the first polar opening, the second polar opening and an entirety of the lateral openings to form a single opening encircling said space, and allowing the air to freely flow, through the single opening and the hollow, in and out of the ventilation channel in multiple directions to enable unobstructed movement of air so as to achieve efficient heat dissipation.

2. The lighting device of claim 1, wherein at least one of the lighting modules has the heat-dissipating side that comprises fins protruding therefrom, the fins being configured to promote transfer of heat energy therein to air that flows along the fins.

3. The lighting device of claim 2, wherein the fins are collectively oriented in a pointing direction approximately parallel to, or approximately perpendicular to, the supporting unit's orientation.

4. The lighting device of claim 2, wherein a substantial portion of the fins is coated with a nanostructure layer, the nanostructure layer being configured to induce micro-turbulences in air that flows on said substantial portion of the fins so as to promote transfer of the heat energy from the fins to surrounding air.

5. The lighting device of claim 1, wherein at least one of the lighting modules has the heat-dissipating side that comprises a nanostructure layer coated thereon, the nanostructure layer being configured to induce micro-turbulences in air that flows on the nanostructure layer so as to promote transfer of heat energy from the aforesaid heat-dissipating side to surrounding air.

6. The lighting device of claim 1, wherein the light-producing side of the heat sink of any of the lighting modules further comprises an accommodating surface for accommodating the one or more light-emitting elements, and wherein the accommodating surface comprises plural sub-surfaces arranged in mutually different orientations so as to provide an illumination angle of light collectively produced by the one or more light-emitting elements substantially wider than an illumination angle obtained if the accommodating surface is flat.

7. The lighting device of claim 6, wherein the sub-surfaces are arranged such that the accommodating surface is convex in shape.

8. The lighting device of claim 6, wherein the sub-surfaces are arranged such that the accommodating surface is concave in shape.

9. The lighting device of claim 1, wherein the joining memeber is further configured to discourage heat transfer from the aforesaid heat-dissipating side to the supporting unit.

10. The lighting device of claim 1, wherein the joining member is remotely controllable.

11. An assembly configured to be used in a lighting device for producing omnidirectional light, the assembly comprising:

a plurality of lighting modules each comprising a heat sink, the heat sink having a light-producing side and a heat-dissipating side opposite to the light-producing side, the light-producing side comprising an accommodating surface configured to accommodate one or more light-emitting elements for producing light, the heat-dissipating side being configured to dissipate heat produced by the one or more light-emitting elements, the lighting modules being circumferentially arranged with the light-producing side of the heat sink of any of the lighting modules facing outward such that generation of the omnidirectional light is allowable; and a supporting unit attached to the heat-dissipating side of the heat sink of each of the lighting modules via a joining member, for providing mechanical support to the lighting modules, wherein each joining member is movable for setting a pointing direction of the lighting module attached thereto such that light collectively produced by the one or more light-emitting elements of any of the lighting modules has a lighting direction that is reconfigurable;

the supporting unit and the lighting modules being arranged and configured such that a space formed by minimally enclosing an entirety of the lighting modules includes a first polar opening, a second polar opening opposite to the first polar opening, and a ventilation channel between the first polar opening and the second polar opening for enabling air flowing through the ventilation channel to carry away at least a portion of heat obtained from the heat-dissipating sides of the heat sinks of the lighting modules to outside said space, wherein:

a line-of-sight path between the first polar opening and the second polar opening is identifiable, allowing a direct flow of air that advances through the ventilation channel from the first polar opening to the second polar opening, or vice versa, to be realizable to thereby promote the carrying away of the at least a portion of heat to outside said space;

regardless of the pointing direction of the joining member of the lighting module set by the joining member, the ventilation channel immediately adjacent the first polar opening is not occupied by the supporting unit, widening a portion of the ventilation channel such that a hollow in the ventilation channel immediately adjacent the first polar opening is created to further promote the carrying away of the at least a portion of heat; and said space further includes a plurality of lateral openings each of which is located between adjacent two of the lighting modules, and is connected to the ventilation channel as well as to both the first and the second polar openings, causing the first polar opening, the second polar opening and an entirety of the lateral openings to form a single opening encircling said space, and allowing the air to freely flow, through the single opening and the hollow, in and out of the ventilation channel in multiple directions to enable unobstructed movement of air so as to achieve efficient heat dissipation.

12. The assembly of claim 11, wherein the accommodating surface comprises plural sub-surfaces arranged in mutually different orientations so as to configure the accommodating surface to provide an illumination angle of light collectively produced by the one or more light-emitting elements substantially wider than an illumination angle obtained if the accommodating surface is flat.

13. The assembly of claim 12, wherein the sub-surfaces are arranged such that the accommodating surface is convex in shape.

14. The assembly of claim 12, wherein the sub-surfaces are arranged such that the accommodating surface is concave in shape.

15. The assembly of claim 11, wherein the supporting unit and an entirety of the lighting modules are preformed as one integrated unit.

* * * * *